US006106130A

United States Patent [19]

Harding

[11] Patent Number: 6,106,130

[45] Date of Patent: Aug. 22, 2000

[54] PERSONAL LIGHTED AND REFLECTIVE SAFETY SYSTEM WITH SHOULDER STRAPS FOR PEDESTRIANS

[76] Inventor: Montgomery G. B. Harding, c/o 208 E. Cobblefield Crescent, Newark, Del. 19713-2268

[21] Appl. No.: 09/203,424

[22] Filed: Nov. 28, 1998

[51] Int. Cl.[7] ..... F21V 21/108

[52] U.S. Cl. ..... 362/108; 362/103; 362/800; 362/251

[58] Field of Search ..... 362/108, 103, 362/800, 251

[56] References Cited

U.S. PATENT DOCUMENTS

| | | | |
|---|---|---|---|
| D. 382,670 | 8/1997 | Sayre | D29/101 |
| 4,184,216 | 1/1980 | Saleen | 441/93 |
| 4,328,533 | 5/1982 | Paredes | 362/108 |
| 4,481,682 | 11/1984 | Hall | 2/326 |
| 4,839,777 | 6/1989 | Janko et al. | 362/108 |
| 5,070,436 | 12/1991 | Alexander et al. | 362/108 |
| 5,129,105 | 7/1992 | Kleinman | 2/328 |
| 5,632,044 | 5/1997 | Sloot | 2/102 |
| 5,690,411 | 11/1997 | Jackman | 362/103 |
| 5,873,187 | 2/1999 | Kozak et al. | 40/612 |

*Primary Examiner*—Sandra O'Shea
*Assistant Examiner*—Ronald E. DelGizzi
*Attorney, Agent, or Firm*—Henry S. Miller

[57] ABSTRACT

A pair of straps configured to resembled suspenders are fitted with lights and electrical circuits which when combined with a power pack radiate flashes of visible light. The power pack may be carried on a belt to which the straps are attached. The circuits allow all or just some of the lights to flash at one time. Reflective material occupies the areas not used by lights.

15 Claims, 7 Drawing Sheets

PERSONAL LIGHTED AND REFLECTIVE SAFETY SYSTEM WITH SHOULDER STRAPS FOR PEDESTRIANS

BACKGROUND OF THE INVENTION

1. Field of the Invention

This invention relates generally to a personal safety system for pedestrians, and in particular to a lighted and reflective safety system that is conveniently suspended on and about the users upper body.

2. The Problem and Relevant Prior Art

Today there prevails an increased interest in physical conditioning which includes outdoors activities such as walking, jogging and running. Since areas designed for these activities are limited, many individuals use streets and roads for exercise. Unfortunately each year a number of walkers, joggers and runners are seriously or fatally injured when they come into contact with motor vehicles. The vast majority of these injuries occur when the operator of a vehicle fails to see and identify an individual, in particular during periods of low visibility as in inclement weather or hours of darkness. Studies have shown that pedestrians do not know how to make themselves visible to motorists. The majority of individuals feel that simply wearing white or light clothing is sufficient to alert drivers to their presence at night. In reality light clothing is only helpful if the vehicle is traveling under 35 miles per hour. At higher speeds the driver has insufficient time to react and brake or maneuver to avoid striking an individual in his path.

A variety of devices and gadgets have been suggested to make not only active pedestrians but also road workers and a public safety workers more visible. Most of the devices in the market place are either wearing apparel or cumbersome outfits to be worn with other clothing. Currently available devices are not easily transferable from one outfit to another. In addition, vest style devices are warm and uncomfortable to wear during strenuous activity.

It is clear then that the only truly safe way to walk, jog or run on streets or roads is by using a safety system that is reto-reflective or lighted. The safest being a system that is both lighted and reto-reflective.

Examples of prior art devices that attempt to solve the problem are shown in U.S. Patents discovered in the records of the U.S. Patent and Trademark Office including: U.S. Pat. No. 5,690,411 issued on Nov. 25, 1997 to Jackman for a wearable vehicular signaling system that allows pedestrians and other road users to signal their intention to change direction; U.S. Pat. No. 5,070,436 issued on Dec. 3, 1991 to Alexander et al discloses a signal vest that reveals a pair of flashing lights on front and rear; U.S. Pat. No. 4,328,533 issued on May 4, 1982 to Paredes shows a safety body harness, which includes flashing lights and reflective luminescent materials; U.S. Pat. No. Des. 382,670 issued Aug. 19, 1997 to Sayre shows a reflective safety vest for bicyclist and backpackers; U.S. Pat. No. 5,632,044 issued May 27, 1997 to Sloot, who discloses a safety vest containing a transparent, waterproof pouch in which a distress message may be displayed; U.S. Pat. No. 4,184,216 was issued Jan. 22, 1980 to Saleen and discloses inflatable suspenders; U.S. Pat. No. 4,481,682 issued Nov. 13, 1984 to Hall discloses another form of suspender, and U.S. Pat. No. 5,129,105 issued Jul. 14, 1992 to Kleinman shows suspenders for fire fighters constructed of inelastic materials.

There is a need for a simple, reliable device that is easily attached to the user that can be worn with any type of clothing by people of any age, size or sex. The prior art taken alone or in combination fails to show or suggest an individual safety system of the type described. The instant invention as disclosed and claimed herein provides distinct and useful advantages not previously known to the prior art.

SUMMARY OF THE INVENTION

The invention is characterized by a plurality of blinking lights spaced between randomly positioned reflective material. The combination is mounted on and becomes an integral part of straps which are configured to resemble suspenders. The straps are made of firm inelastic material and contain various bright background colors. When assembled in the form of the well known design and shape of suspenders, the safety system comprises two straps worn over the shoulder, beginning near the waist in back of the user and ending near the waist in front of the user. The straps cross near the middle of the back of the user. At each end of both straps is a connector to secure the strap to a belt or article of clothing. The straps are not adjustable but vary in length and width to accommodate the age, size and preference of the wearer. Each strap may include a small segment of elastic material in order to provide a more comfortable fit for the user.

The straps are formed of a material that allows impregnation with durable reflective materials of different colors such as glass, plastic or other material that reflects light. Included with the reflective material are the necessary lights, wiring and other circuitry required to satisfy the objects of the invention.

Electrical power for lighting luminaries is supplied by a battery pack that is carried on a belt around the wearer's waist, or it may be otherwise attached to the wearer's waist band such as with a common clip. If a single circuit is utilized, a single switch will control all the lights on the straps, however in the alternative two circuits are used one switch will control 50% of the front lights and 50% of the back lights and another switch will control the other 50% of the front lights and 50% of the back lights, thereby allowing the amount of lighting to be varied according to the degree of hazard.

The invention is intended to provide a means by which the user is seen by motorists in darkness and dim light. The safety system is designed with a range width of straps to allow for variation in sizes of wearers. The straps are impregnated with durable bright colored reflective luminescent material and rows of small light bulbs or light emitting diodes connected to a battery powered electrical circuit.

Accordingly, it is a principal object of the invention to provide a simple, dependable and reliable individual safety system.

It is another object of the invention to provide an individual safety system that is easily donned and doffed by the user.

It is a further object of the invention to provide an individual safety system that is more comfortably worn by the user than known like existing systems.

It is still another object of the invention to provide an individual safety system that has less bulk than known like existing systems.

It is still a further object of the invention to provide an individual safety system that allows for variation in lighting intensity according to the degree of hazard.

It is another object of the invention to provide a new and improved individual safety system which may be easily and efficiently manufactured and marketed.

These, together with other objects of the invention, along with the various features of novelty which characterize the invention, are pointed out with particularity in the claims annexed to and forming part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will apparent when consideration is given to the following detailed description thereof. Such description makes reference to the annexed drawings wherein.

DETAILED DESCRIPTION OF A PREFERRED EMBODIMENT

Figure 1:
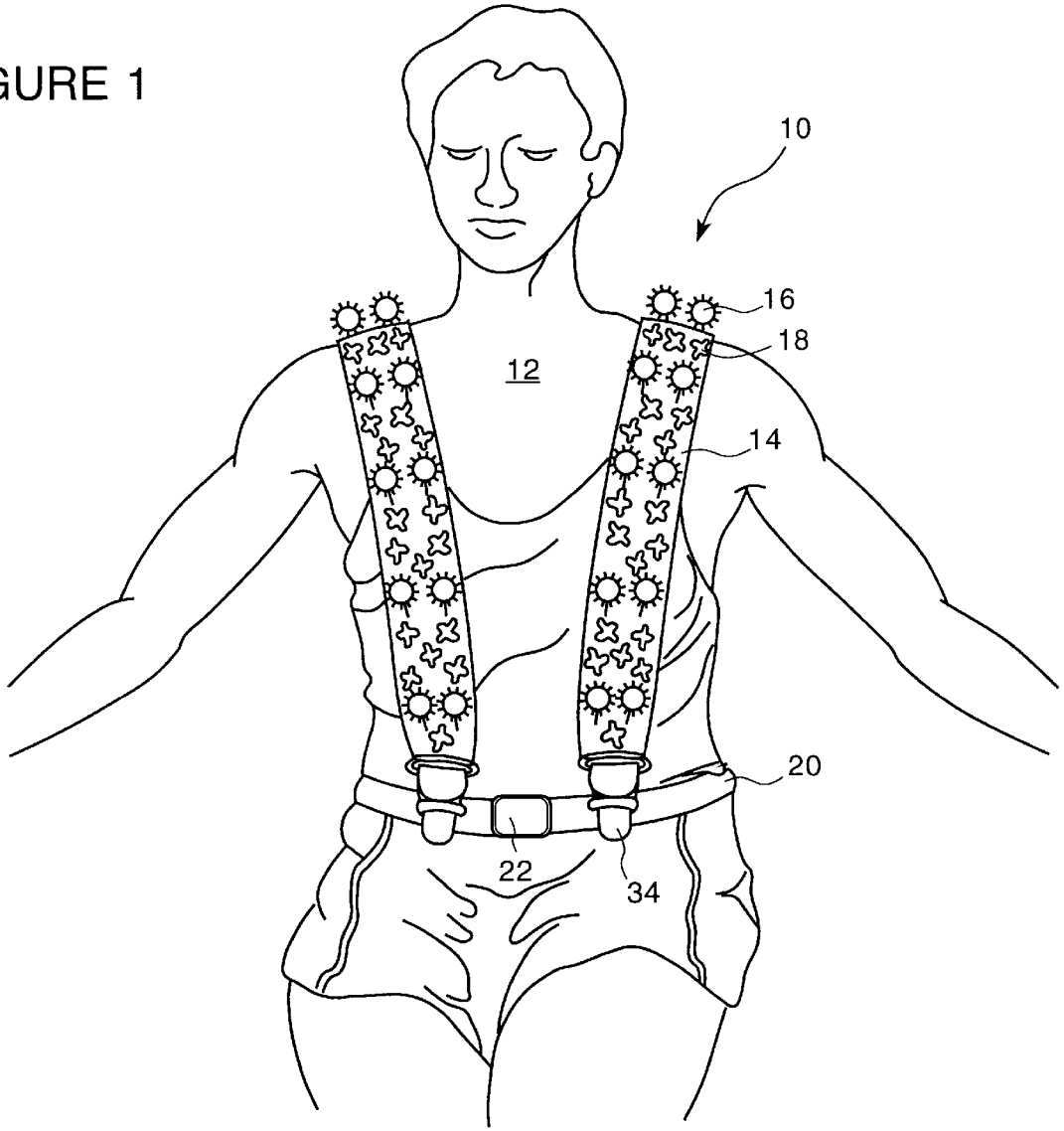
FIG. 1 is a front environmental view of the system according to the present invention.
Figure 2:
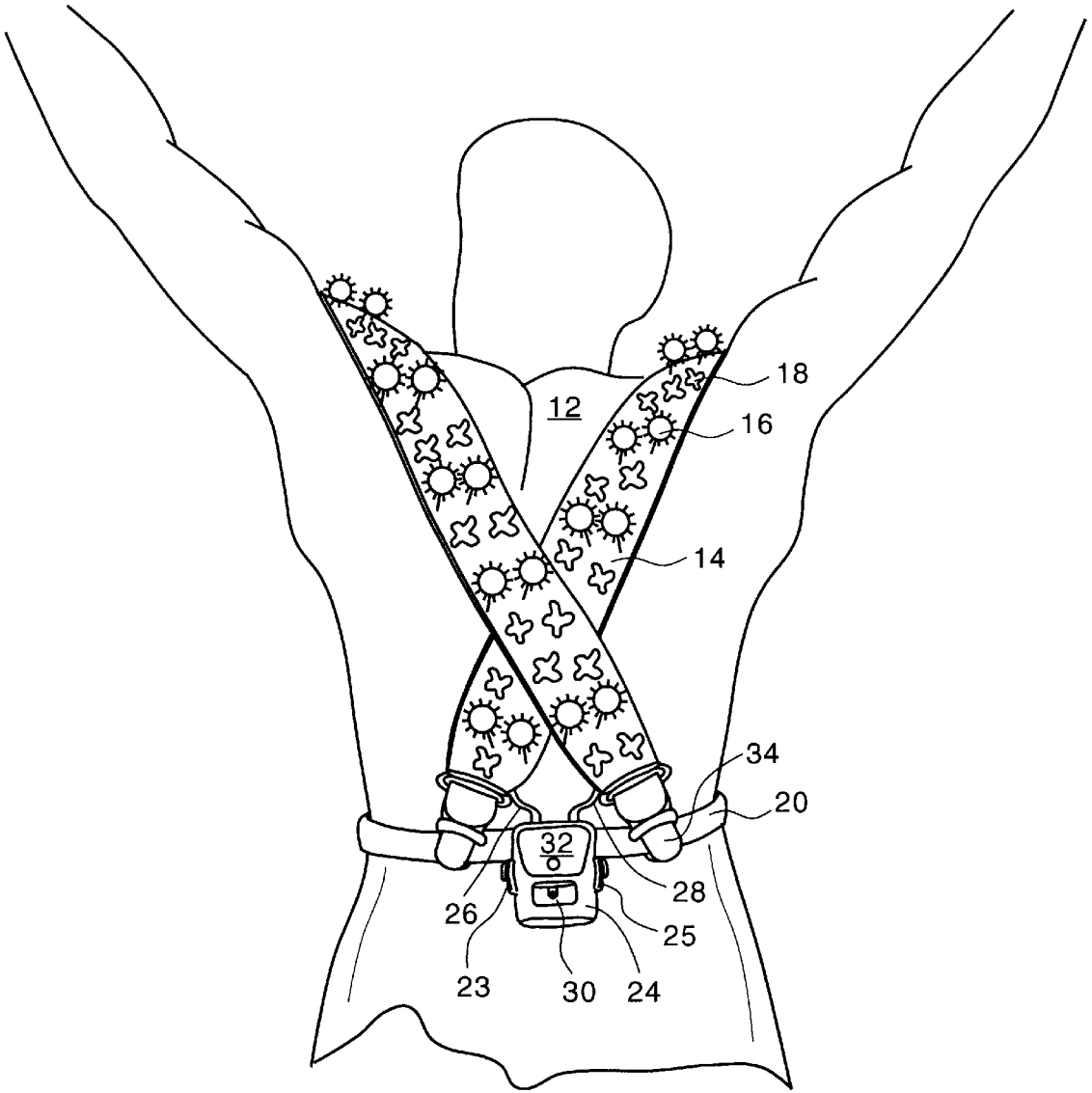
FIG. 2 is a rear environmental view of the system according to the present invention.

Referring now to FIGS. 1 and 2, the invention is shown generally at 10 as it is worn by a user 12. FIG. 1 being the front view and FIG. 2 the back view. A pair of straps 14 carry luminaries 16 in the preferred form of light emitting diodes or light bulbs. Reto-reflective materials 18 formed of a durable material such as glass or plastic are preferably impregnated into the strap, although other suitable forms of attachment, such as adhesive or mechanical means are acceptable. The straps are in the color of internationally accepted standards for safety or distress such as, for example yellow or orange.

The straps 14 connect at the waist of the user by means of clips 34 or other suitable and well known connection means. Connection is made to either the clothing or a belt 20, with a buckle 22 worn for the purpose of securing the ends of straps 14. Attached to the belt or clothing, preferably in the back is a battery pack-power supply 24. A battery of appropriate size and voltage is contained within a case of nylon, leather or other material, along with electrical circuits described in more detail hereinafter. If the system contains an option of utilizing either a single electrical circuit or two electrical circuits, each supplying power to fifty percent of the luminaries, for two circuit selection switches 23, 25 are provided, for a single circuit supplying power to all luminaries a single switch 30 is available. The power pack container 24 includes a cover 32 for access to the battery or other circuit components. Electrical power is carried from the power pack to each strap via wires 26 and 28.

Figure 3:
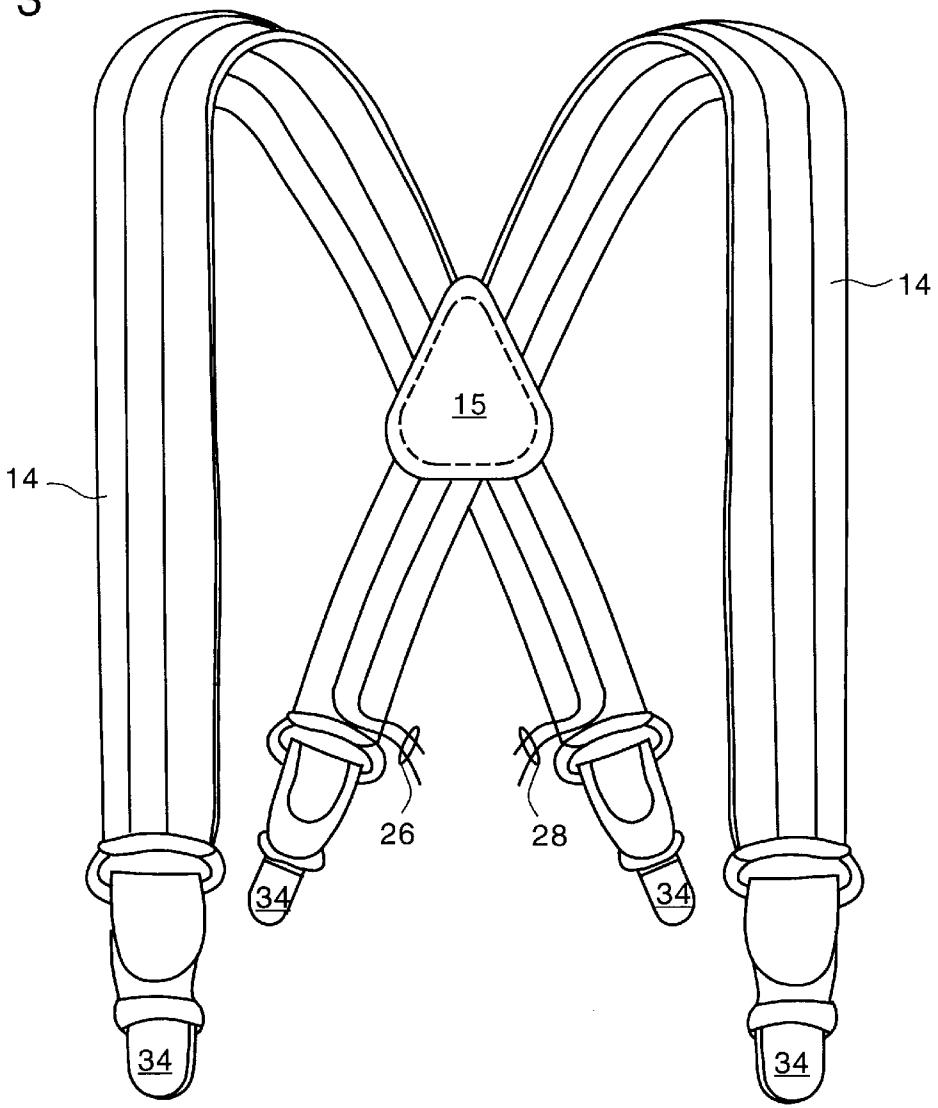
FIG. 3 is a front view of the invention showing placement of the electrical conductors.

Concerning FIG. 3, a pair of straps 14 are shown, secured from relative movement by member 15. The straps may be formed of nylon, Velcro or other suitable material such as plastic or leather. Member 15 is formed of any material that is compatible with the strap material. Clips 34 are attached at each end of each strap and shown as alligator clips for easy attachment to a belt or other article of clothing. The invention is not limited in scope to alligator clips, as other known means of attachment such as hook and loop material, would work as well if the attachment points were adapted to receive the known means. Wires 26 and 28 from the power supply over lie the strap base material as protected by a layer of insulative material.

Figure 4:
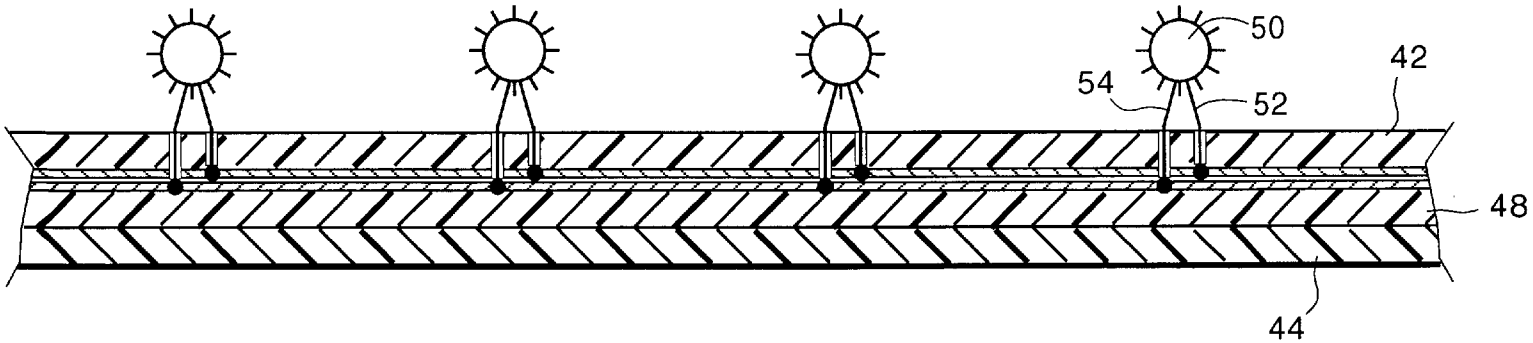
FIG. 4 is an enlarged cross sectional view of the strap of the invention.
Figure 4A:
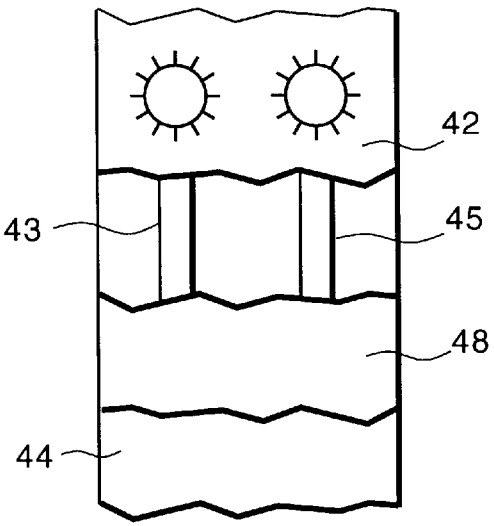
FIG. 4A is a top plan view cut away showing the layers of the strap of the invention.

Concerning FIGS. 4 and 4A, the strap consists of a base layer 44 of strong, material with a low coefficient of elasticity such as nylon. Bonded by means well known in the art is a layer of dielectric material 48 to provide an insulative medium between wires shown in FIG. 4A as 43 and 45. Finally, a top layer of material 42 having either a reflective surface, or a brightly colored surface with reflective materials attached in a random pattern. The layers are bonded together forming a sandwich of layers forming a strap. Luminaries 50 are attached to the strap via leads 52,54 which connect to the circuit wires 43,45.

Figure 5:
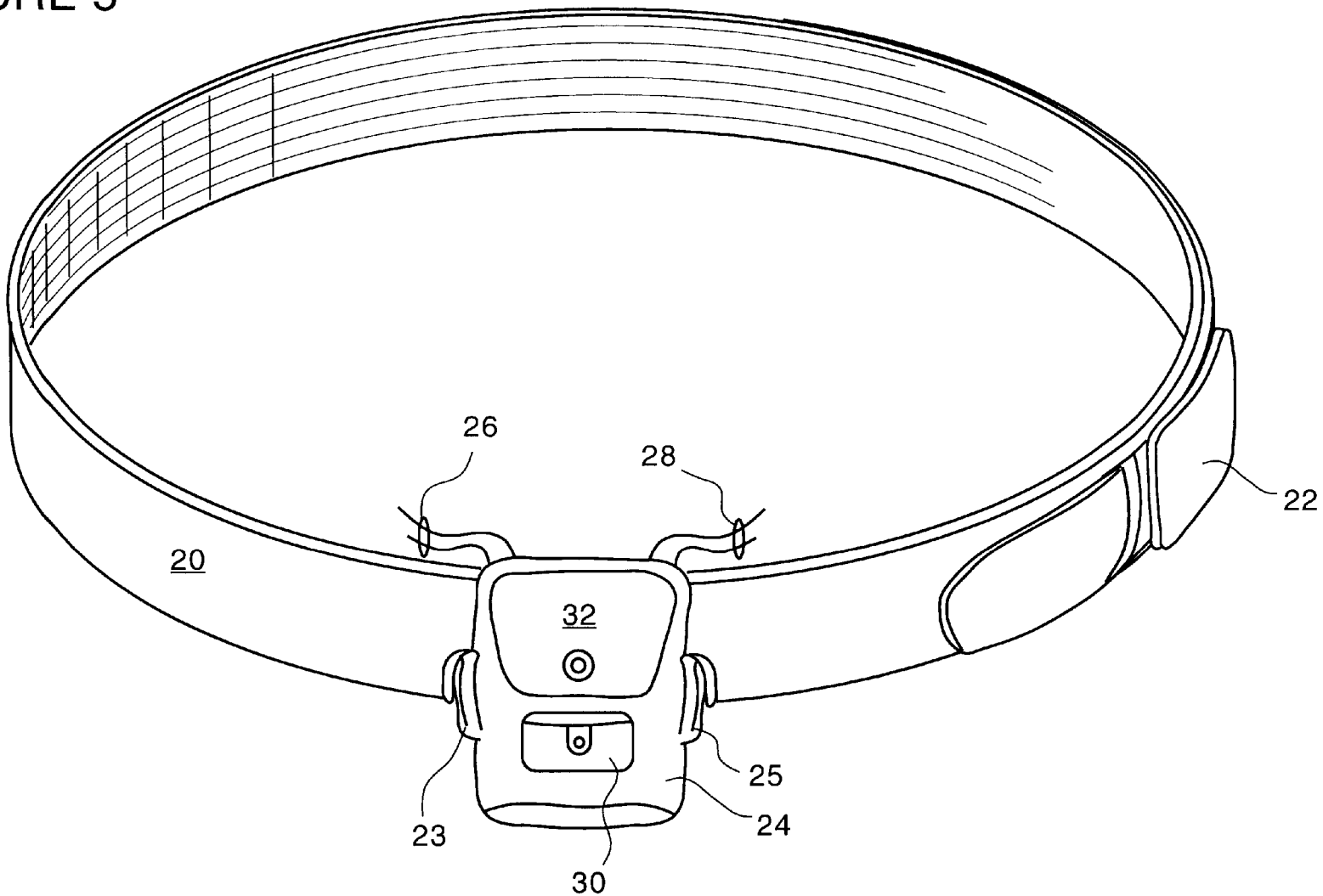
FIG. 5 is a perspective view of the power pack and belt in accordance with the invention.

FIG. 5 shows a conventional belt 20, with buckle 23, which may be worn by the user and to which the straps may be connected. In addition, power pack 24 is connected to the belt preferably by a belt loop, not shown or a belt clip, not shown but well known in the art. Wires 26 and 28 exit the power pack proximal to the belt, where it is convenient to connect to the straps. Where the system is used as single circuit connecting all luminaries a single on-off switch is provided. If the system utilizes dual circuits, each controlling fifty percent of the luminaries, two switches 23,25 are provided. The power pack case includes a cover 32 to allow for changing batteries and servicing the controlling circuits. In the event bulbs, capable of flashing, are used as luminaries a single switch connects the battery directly to the luminary in the strap 14.

Figure 6:
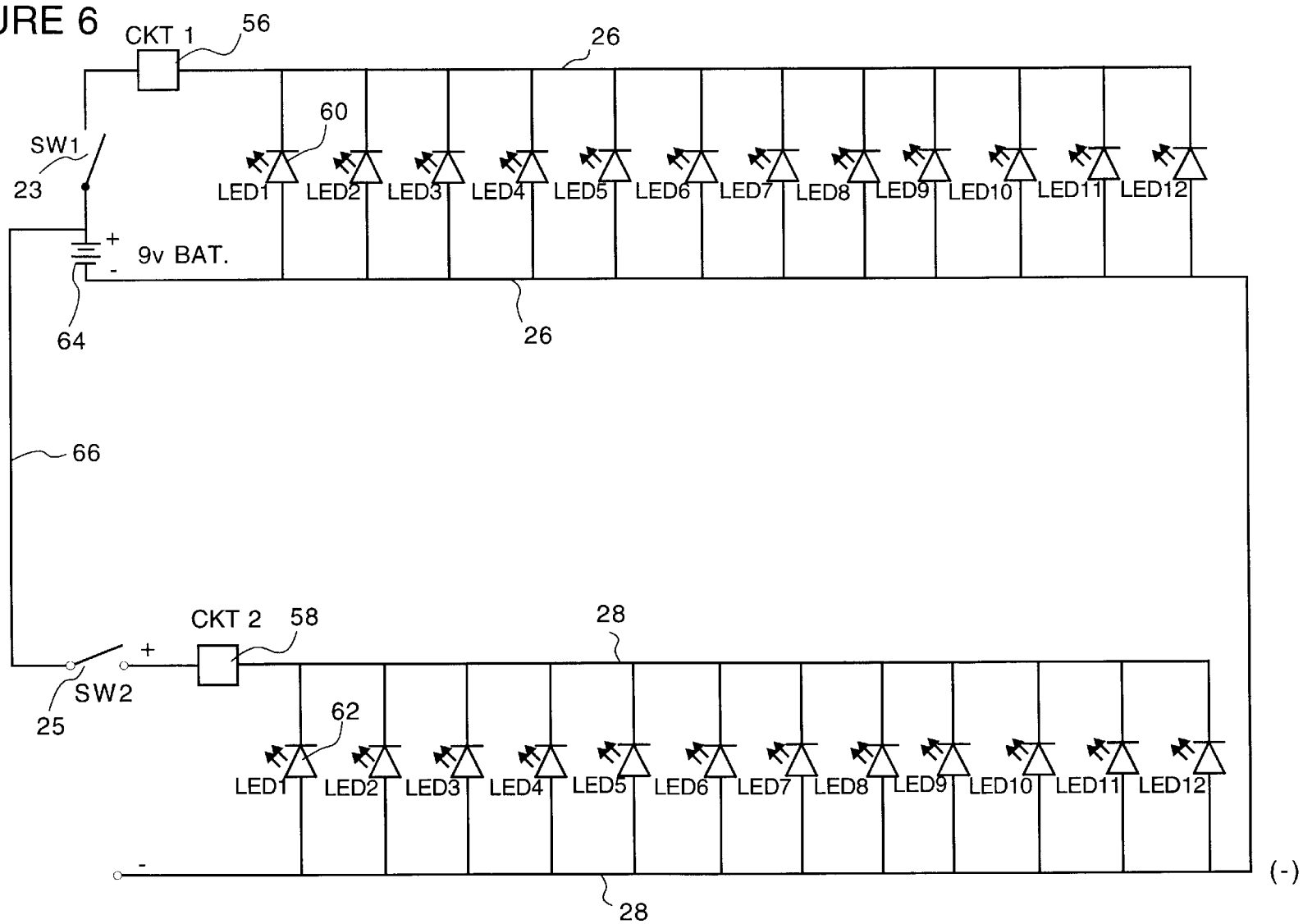
FIG. 6 is a wiring diagram of the invention.

FIG. 6 discloses a representative electrical circuit for controlling luminaries in the form of light emitting diodes (LED). The circuit is located within power pack 24. Light emitting diodes 60,62 are located in straps 14 and are connected to power pack 24 via leads 26 and 28. The power pack contains a battery 64, which may be of the rechargeable type and for this application has a potential of 9 volts. Switch 23 activates a first common free running multivibrator circuit 56 which activates 50% of the total LED's with one-half activated on the front side of the user and the other one-half activated on the back of the user. Activation by circuit 56 causes the lights to flash on and off at a regular interval. Thus making the user more noticeable to motorists.

When visibility conditions require, a second free running multivibrator circuit 58 identical to the first is activated by closing switch 25, thereby connecting the circuit to battery 64 via lead 66. Activation by circuit 58 causes the remaining LED's 62 to flash on and off at a regular interval.

Figure 7:
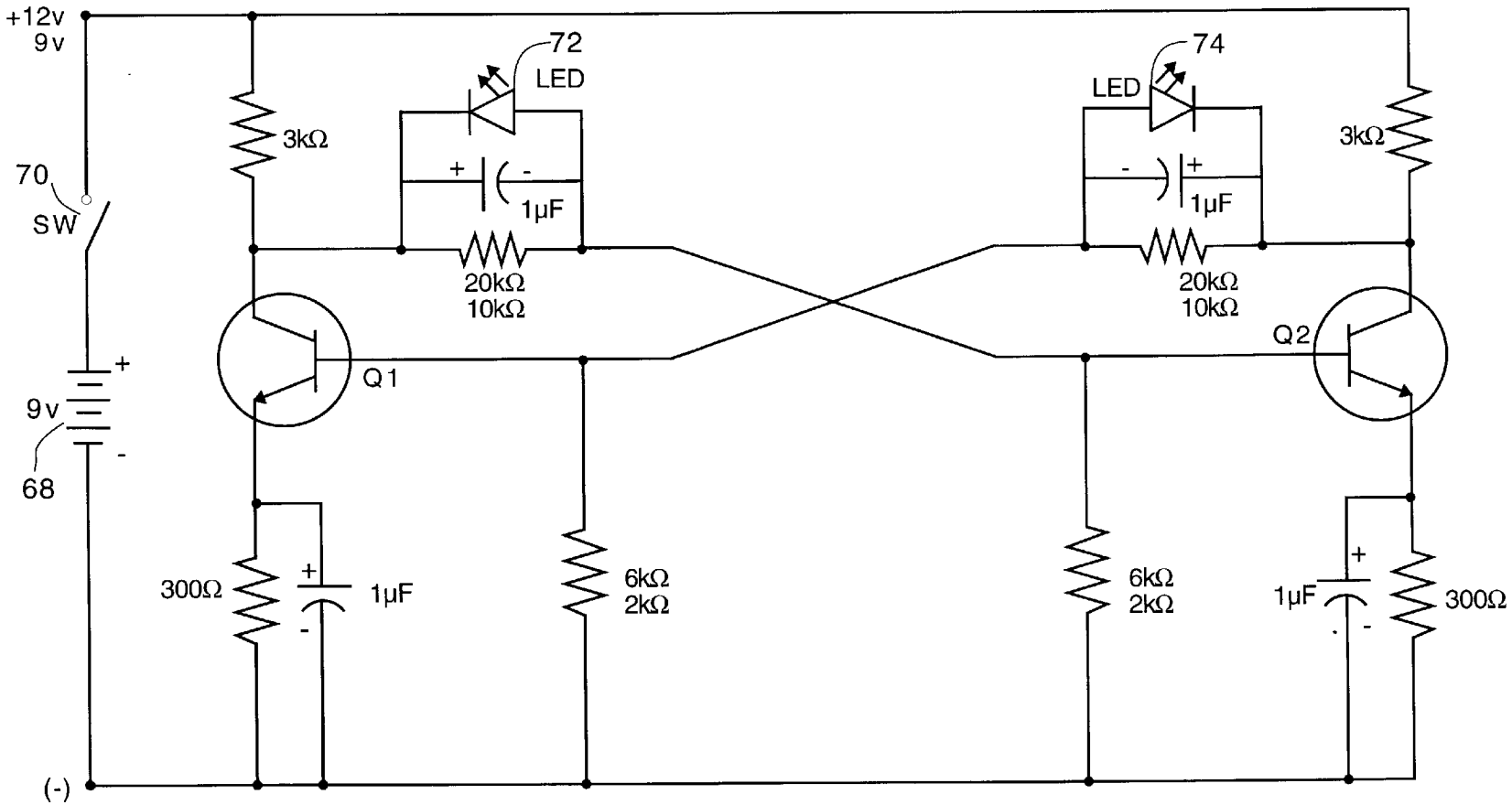
FIG. 7 is diagram of a multivibrator circuit used in the invention.

FIG. 7 shows a typical free running multivibrator circuit similar to 56 and 58 described hereinbefore. A source of voltage, such as battery 68 supplies energy to the circuit when switch 70 is closed thereby causing LEDs 72 and 74 to alternately and continuously flash on and off.

It should be understood, of course, that the foregoing disclosure relates to only a preferred embodiment of the invention and that numerous modifications or alterations may be made therein without departing from the spirit and scope of tile invention as set forth in the appended claims.

What is claimed is:

1. A personal safety system for pedestrians comprising a first strap having more than one end adapted to pass over the first shoulder and be secured at the waist of the user;

a second strap having more than one end adapted to pass over the second shoulder and be secured at the waist of the user;

securing means attached at the end of each strap;

one surface forming visible light reflecting means;

means for producing light attached to and forming a part of each strap;

a source of electrical current operatively associated with each strap, and electrical circuit means connected between the means for producing light and the source of electrical current, whereby the said source powers the means for producing light.

2. A personal safety system for pedestrians according to claim 1 further including: means, to be worn around the waist of the user, for securing the ends of the first and second strap.

3. A personal safety system for pedestrians according to claim 2 wherein: the means worn around the waist is a belt.

4. A personal safety system for pedestrians according to claim 1 wherein: the securing means is an alligator clip.

5. A personal safety system for pedestrians according to claim 1 wherein: the securing means includes hook and loop material.

6. A personal safety system for pedestrians according to claim 4 wherein: the means for reflecting visible light includes glass beads.

7. A personal safety system for pedestrians according to claim 4 wherein: the means for reflecting visible light includes plastic beads.

8. A personal safety system for pedestrians according to claim 6 wherein: the means for producing visible light are light emitting diodes.

9. A personal safety system for pedestrians according to claim 6 wherein: the means for producing visible light are light bulbs with a capability of flashing.

10. A personal safety system for pedestrians according to claim 8 wherein: the source of electrical current is a battery.

11. A personal safety system for pedestrians according to claim 10 wherein: the battery is in a container attached at the waist of the user.

12. A personal safety system for pedestrians according to claim 11 wherein: the electrical circuit includes, a first switch means and a second switch means, where each switch controls the on-off operation of half the total number of visible light producing means.

13. A personal safety system for pedestrians according to claim 11 wherein: the electrical circuit includes, a single switch which controls all tile visible light producing means.

14. A personal safety system for pedestrians according to claim 12 wherein: the electrical circuit includes at least one free-running multivibrator unit thereby causing the visible light producing means to flash at regular intervals.

15. A strap for personal safety systems comprising:

A first layer of inelastic material having defined end limits;

A second layer of dielectric material overlying the first layer;

A pair of flat, electrically conductive means overlying the dielectric material, and extending, at one end beyond the end limit of the strap;

A third layer of light-reflective material overlying the second layer, forming a sandwich of material, and A plurality of electric luminaries connected to the conductive means and extending outwardly through the reflective material means, whereby, a source of electrical power connected to the conductive means will cause the luminaries to radiate visible light.

* * * * *